US007775771B2

(12) United States Patent
Wang

(10) Patent No.: US 7,775,771 B2
(45) Date of Patent: Aug. 17, 2010

(54) QUICK ASSEMBLY BLADE FOR A CEILING FAN

(75) Inventor: Cliff Wang, Tanzih Township, Taichung County (TW)

(73) Assignee: Air Cool Industrial Co., Ltd., Taichung County (TW)

( * ) Notice: Subject to any disclaimer, the term of this patent is extended or adjusted under 35 U.S.C. 154(b) by 561 days.

(21) Appl. No.: 11/832,690

(22) Filed: Aug. 2, 2007

(65) Prior Publication Data

US 2009/0035143 A1 Feb. 5, 2009

(51) Int. Cl.
*F04D 29/34* (2006.01)

(52) U.S. Cl. ..... 416/210 R; 416/207

(58) Field of Classification Search ..... 416/210 R, 416/204 R, 207, 244 R, 214 R, 220 R; 464/70, 464/71

See application file for complete search history.

(56) References Cited

U.S. PATENT DOCUMENTS 7,223,078 B1 * 5/2007 Mares et al. ..... 416/210 R

* cited by examiner

*Primary Examiner*—Edward Look
*Assistant Examiner*—Dwayne J White
(74) *Attorney, Agent, or Firm*—Ming Chow; Sinorica, LLC

(57) ABSTRACT

A quick assembly blade for a ceiling fan includes a blade frame fixed inside with at least three studs respectively for a fastener to be inserted therein. A blade to be secured on the blade frame is bored with three assembling holes at the locations corresponding to the studs of the blade frame, and a clamping member made of elastic material is fixed on the blade. The clamping member is cut with three engage notches at the locations corresponding to the fasteners. The clamping member has its opposite sides compressed transversely to be received among the fasteners and, after released, the clamping member will recover its elastic force and have its engage notches respectively and quickly engaged on the fasteners, thus achieving effect of quickly and stably assembling the blade of the ceiling fan.

3 Claims, 4 Drawing Sheets

QUICK ASSEMBLY BLADE FOR A CEILING FAN

BACKGROUND OF THE INVENTION

1. Field of the Invention

This invention relates to a ceiling fan blade, particularly to one able to be assembled quickly and stably.

2. Description of the Prior Art

A device for assembling a blade of a conventional ceiling fan shown in FIG. 1 has a blade 1 provided with a fit projection 2 at a location corresponding to a blade frame (not shown) under the blade 1, and the blade 1 is bored with three insert holes 3 spaced apart equidistantly around the circumference of its narrow end for fasteners 4 to be respectively locked therein. The fit projection 2 is a spring made of elastic material and shaped as a semi-circular frame fixed around the circumference of the narrow end of the blade 1, having its intermediate end formed with an outward-bent clasping member 5 at a location corresponding to a fastener 4 under the fit projection 2 and also having its opposite free ends respectively provided with an inward-bent clasping member 5 at a location facing two parallel fasteners 4. In assembling of the fit projection 2, the intermediate clasping member 5 of the fit projection 2 is first clasped on the corresponding fastener 4. Next, the opposite free ends of the fit projection 2 are compressed inward to shorten the distance between them and force the fit projection 2 to pass the two parallel fasteners 4 and then the opposite free ends of the fit projection 2 are released to let their clasping members 5 respectively and correspondingly clasped on the two parallel fasteners 4.

However, although the fasteners 4 can be fixed in position by the fit projection 2 after the fit projection 2 recovers its elastic force, yet, when the fit projection 2 is compressed for positioning its opposite free ends, the intermediate clasping member 5 may be deformed and disengaged from the fasteners 4; therefore, it is necessary to gradually slacken the opposite ends of the fit projection 2 and slowly push the intermediate clasping member 5 of the fit projection 2 to be aligned to and clasped with the fastener 4, impossible to effectively and quickly engaging the fit projection 2 with the clasping members 4, and taking too much time and labor in assembling of the blade. Moreover, the fit projection 2 is a semi-circular frame with weak structural strength, so there is no sufficient strength to press against the topside of the blade 1, rendering the blade 1 impossible to be assembled stably.

SUMMARY OF THE INVENTION

The objective of this invention is to offer a quick assembly blade for a ceiling fan, mainly including a blade frame, a blade and a clamping member. The blade frame is fixed inside with at least three studs spaced apart equidistantly and extending upward respectively for a fastener to be inserted therein. The blade to be secured on the blade frame is bored with three assembling holes at the locations corresponding to the three studs of the blade frame for the fasteners to be inserted therethrough. The clamping member is a long-grooved plate made of elastic material to be secured on the blade. The clamping member has the opposite outer sides in its longitudinal direction respectively provided with an elongate handling portion, having an elastic portion formed between the two operating portions. Each handling portion of the clamping member has its bottom edge connected with a clamping portion extended outward and cut with engage notches having their openings respectively facing the fasteners. In assembling, simply apply a transverse force upon the opposite handling portions of the clamping member to enable the clamping member to be received and extended among the fasteners. After released from the transverse force, the clamping member will recover its elastic force to have its engage notches respectively and quickly engaged with the fasteners, letting the clamping member quickly and firmly clamped and pressed on the blade. By so designing, the blade of this invention can be assembled with quickness and with stability.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
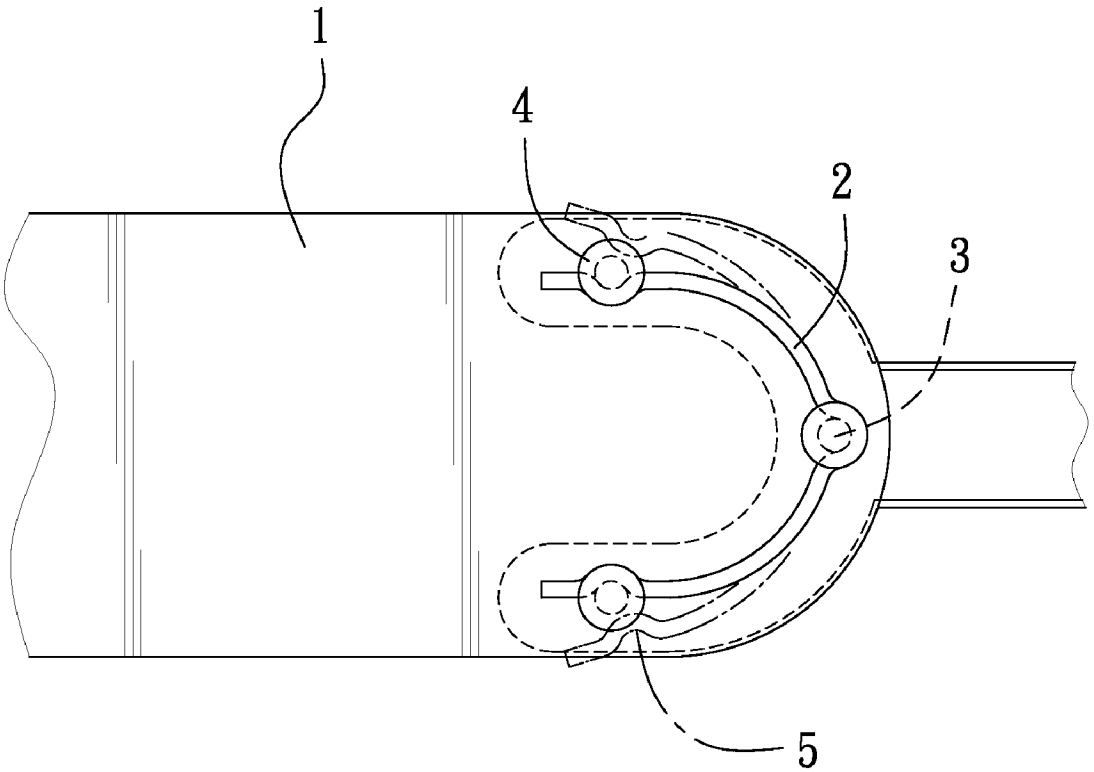
FIG. 1 PRIOR ART
FIG. 1 is an exploded perspective view of a blade assembly device for a conventional ceiling fan.
Figure 2:
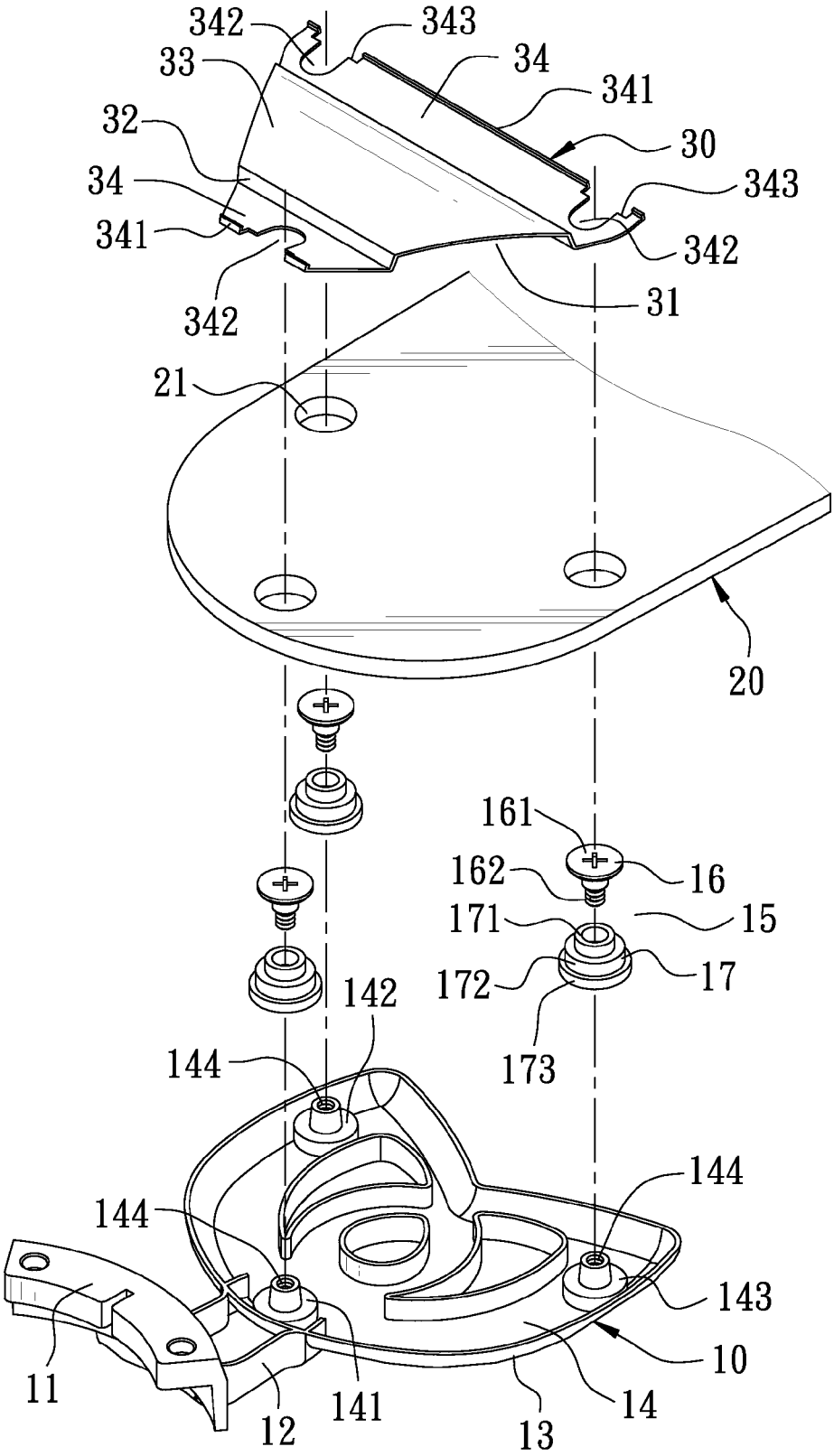
FIG. 2 is an exploded perspective view of a quick assembly blade for a ceiling fan in the present invention.

A preferred embodiment of a quick assembly blade for a ceiling fan in the present invention, as shown in FIG. 2, includes a blade frame 10, a blade 20 and a clamping member 30.

The blade frame 10 is formed integral with a fixed portion 11, a neck portion 12 and a blade connecting portion 13. The fixed portion 11 is shaped as an arc-shaped vertical plate to be connected with a motor (not shown) of ceiling fan blades, having its lower end extended horizontally and formed with the neck portion 12, which has the other end connected with the blade connecting portion 13. The blade connecting portion 13 is provided thereon with a pan-shaped holding surface 14 facing upward and having its circumference annularly secured with three vertical studs 141, 142, 143 spaced apart equidistantly. The stud 141 is positioned abutting the neck portion 12, and the stud 142 and the stud 143 parallel to each other are respectively positioned at the left and the right side opposite to the stud 141, with the three studs 141, 142, 143 respectively bored with a threaded hole 144 in the center for a fastener 15 to be inserted and locked therein. In this preferred embodiment, the fastener 15 is composed of a locking member 16 and a tightening ring 17. The locking member 16 is a bolt formed with a head 161 extending downward to form a threaded section 162, and the tightening ring 17 made of plastic is composed of an upper small-sized columnar member 171, an intermediate medium-sized columnar member 172 and a lower large-sized columnar member 173. The three locking members 16 have their lower threaded sections 162 respectively inserted through the three tightening rings 17 and engaged with the threaded holes 144 of the studs 141, 142 and 143.

The blade 20 to be fixed on the blade frame 10 has the circumference of its narrow end bored with three assembly holes 21 at the locations corresponding to the three studs 141, 142 and 143, and the fasteners 15 are respectively inserted through the assembly holes 21 and have the columnar members 172 of the tightening rings 17 respectively stuck on the inner wall of the assembly hole 21, letting the head 161 of the fastener 15 protrude out of the topside of the blade 20 and enabling the blade 20 quickly positioned on the blade frame 10.

The clamping member 30 to be secured on the blade 20 corresponding to the location of the blade frame 10 is a long-grooved plate made integrally of elastic material and having an open end 31 transversely formed in its long shaft direction and downward facing the blade 20. The clamping member 30 is formed with two elongate handling portions 32 respectively positioned at the opposite outer sides in its longitudinal direction, with an elastic portion 33 formed between the two handling portions 32. The opposite handling portions 32 have their lower edge connected with a clamping portion 34 with a proper height extending outward and upward obliquely. The first clamping portion 34 corresponding to the studs 142 and 143 of the blade frame 10 is comparatively long for matching with the width of the circumference of the wide end of the blade 20. The second clamping portion 34 corresponding to the stud 141 is short to match with the narrow end of the blade 20. Further, the two clamping portions 34 have their outer edge protruding upward and formed with a reinforcing rib 341, and the first clamping portion 34 has its outer edge cut with two end notches 342 and the second clamping portion 34 has its outer edge cut with an engage notch 342, with the three engage notches 342 respectively corresponding to the three assembly holes 21 of the blade 20 and having their openings respectively facing the fasteners 15. Each engage notch 341 is U-shaped, having the outer end of its opening formed with a comparatively large opening 343.

Figure 3:
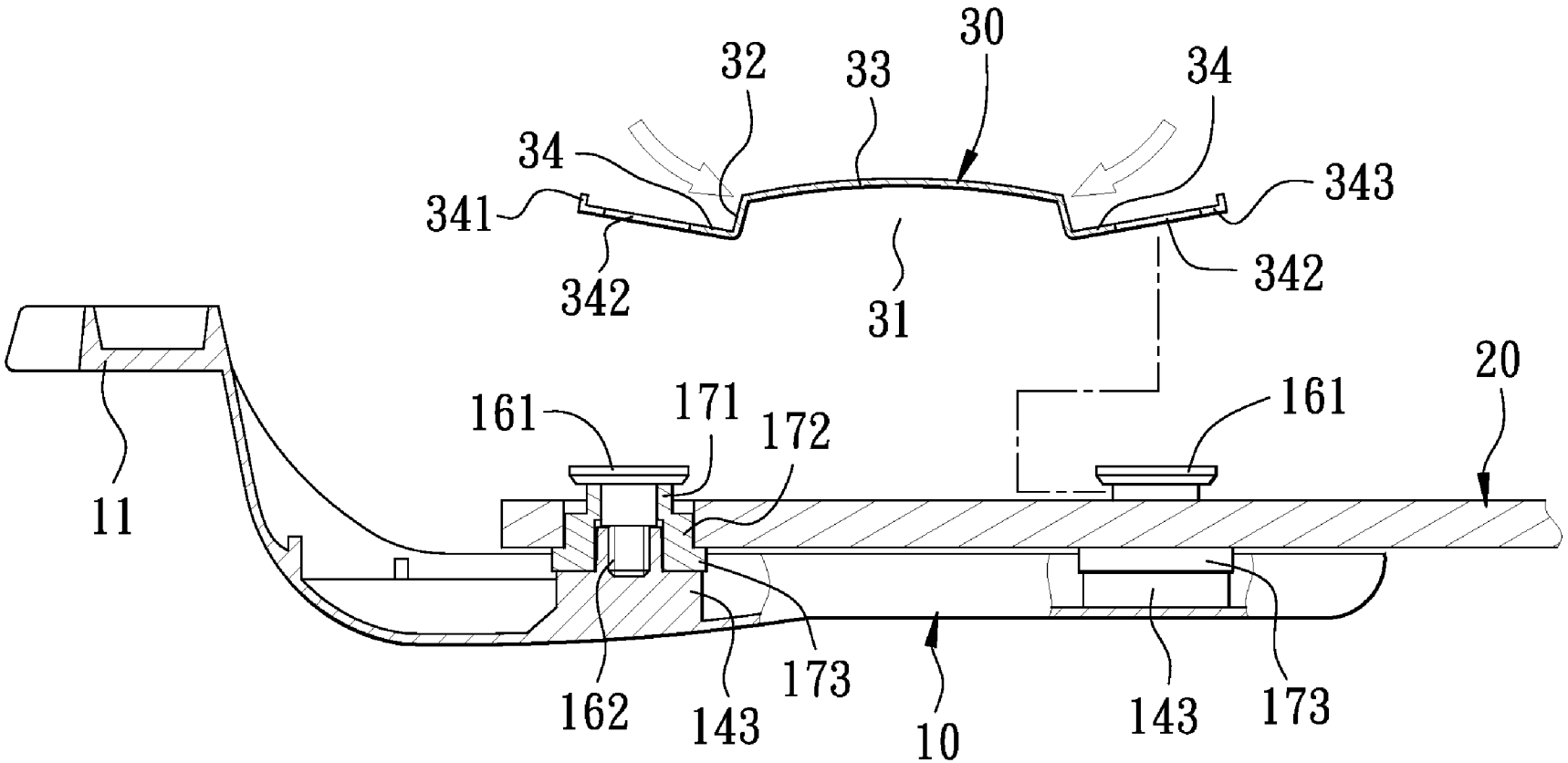
FIG. 3 is a partial exploded and side cross-sectional view of the quick assembly blade for a ceiling fan in the present invention.
Figure 4:
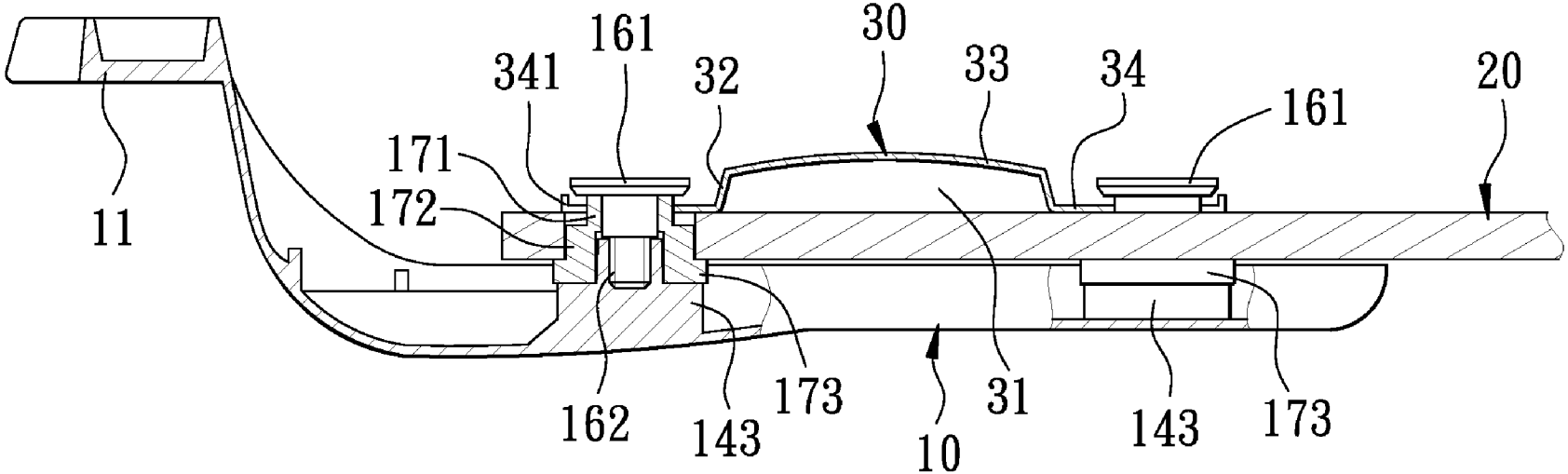
FIG. 4 is a side cross-sectional view of the quick assembly blade for a ceiling fan in the present invention.

In assembling of the ceiling fan blade, as shown in FIG. 3, firstly, the fasteners 15 have the threaded sections 162 under the locking members 16 respectively inserted through the tightening rings 17 and then engaged with the studs 141, 142 and 143 of the blade frame 10. Next, the blade 20 has its assembly holes 21 respectively passing through the studs 141, 142 and 143 and fitted tightly with the columnar member 172 of the tightening ring 17, letting the head 161 of the fastener 15 and the columnar member 171 of the tightening ring 17 protrude out of the topside of the blade 20 and restrictedly positioning the blade 20 on the blade frame 10. Subsequently, hold the two opposite handling portions 32 of the clamping member 30 and apply a transverse and inward squeeze upon the two operating portions 32 to force the elastic portion 33 between the two operating portions 32 to be deformed so that the clamping member 30 after compressed can be received and extended among the three fasteners 15. After released from the transverse squeeze, the clamping member 30 will recover its original shape by its restored elastic force; therefore, the engage notches 342 of the clamping member 30, which are respectively formed with a comparatively large opening 343, can be respectively and quickly fitted with the columnar members 171 of the tightening rings 17. Lastly, lock tight the heads 161 of the locking members 16 to finish assembling of the blade 20. When the blade 20 of the ceiling fan is to be disassembled and replaced, simply apply a transverse and inward squeeze upon the opposite operating portions 32 of the clamping member 30 to let the clamping member 30 compressed inward and its the engage notches 342 quickly disengaged from the tightening rings 17. Thus, the clamping member 30 can be disassembled, and the blade 20 and the blade frame 10 can be separated from each other after the fasteners 15 are unfastened.

Specifically, this invention has the following advantages.

1. The two opposite clamping portions of the clamping member can be effectively and quickly clamped and pressed on the blade only by applying a transverse squeeze upon the opposite operating portions of the clamping member to let the clamping member received and extended among the fasteners, and then release the clamping member from the transverse squeeze to let the clamping member recover its elastic force and tightly engaging its engage notches on the fasteners, thus able to quickly assemble the blade on the blade frame.

2. The open end of each engage notch of the clamping member is formed with a comparatively large opening to enable the clamping member to be easily engaged with the fasteners and firmly clamped and pressed on the blade, facilitating the blade to be assembled with quickness.

While the preferred embodiment of the invention has been described above, it will be recognized and understood that various modifications may be made therein and the appended claims are intended to cover all such modifications that may fall within the spirit and scope of the invention.

I claim:

1. A quick assembly blade for a ceiling fan, said blade comprising:

a blade frame formed integral with a fixing portion, a neck portion and a blade connecting portion, said blade connecting portion formed with a holding surface facing upward, said holding surface having its circumference annularly fixed with three studs spaced apart equidistantly, said three studs respectively bored with a threaded hole in the center, said threaded hole of said studs respectively having a fastener secured therein, said fastener provided with a head;

a blade having an underside of one end fixed on said blade frame, said blade having the circumference of its narrow side bored with three assembling holes at the locations corresponding to said three studs of said blade frame;

a clamping member secured on said blade at a location corresponding to said blade frame, said clamping member being a long-grooved plate made integrally of elastic material, said clamping member transversely bored with an opening positioned in its longitudinal direction and facing said blade below, said clamping member having the opposite outer sides in its longitudinal direction respectively disposed with an elongate handling portion, having an elastic portion formed between said elongate handling portions, each said elongate handling portion having its lower edge connected with a clamping portion extended outward, said clamping portion cut with engage notches having their openings respectively facing said fasteners; and each said clamping portion of said clamping member is a long plate extending upward obliquely.

2. The quick assembly blade for a ceiling fan as claimed in claim 1, wherein said fastener is provided from under to above with a tightening ring and a locking member, said tightening ring made of plastic and composed of an upper small-sized columnar member, an intermediate medium-sized columnar member and a low large-sized columnar member, said locking member having its head extending downward and formed with a threaded section, said threaded section inserted through said tightening ring and engaged with said stud of said blade frame.

3. The quick assembly blade for a ceiling fan as claimed in claim 1, wherein said engage notch of said clamping member is U-shaped and has its open end formed with a comparatively large opening.

* * * * *